US009784077B2

(12) United States Patent
Gorrara et al.

(10) Patent No.: US 9,784,077 B2
(45) Date of Patent: Oct. 10, 2017

(54) APPARATUS AND A METHOD FOR SECURING AND SEALING A TUBULAR PORTION TO ANOTHER TUBULAR

(75) Inventors: Andrew John Gorrara, Stonehaven (GB); Peter Wood, Hatton of Fintray (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 764 days.

(21) Appl. No.: 14/005,294

(22) PCT Filed: Mar. 21, 2012

(86) PCT No.: PCT/GB2012/050618

§ 371 (c)(1),
(2), (4) Date: Nov. 15, 2013

(87) PCT Pub. No.: WO2012/127229

PCT Pub. Date: Sep. 27, 2012

(65) Prior Publication Data

US 2014/0076581 A1 Mar. 20, 2014

(30) Foreign Application Priority Data

Mar. 21, 2011 (GB) ..... 1104694.3

(51) Int. Cl.
*E21B 43/10* (2006.01)

(52) U.S. Cl.
CPC ..... *E21B 43/10* (2013.01); *E21B 43/103* (2013.01)

(58) Field of Classification Search
CPC ..... E21B 43/10; E21B 43/103; E21B 23/01; E21B 23/06; E21B 43/106; E21B 43/108
See application file for complete search history.

(56) References Cited

U.S. PATENT DOCUMENTS 4,979,570 A * 12/1990 Mody ..... E21B 33/1295 166/187
6,123,148 A * 9/2000 Oneal ..... E21B 23/01 166/118
7,347,274 B2 * 3/2008 Patel ..... E21B 33/128 166/120
8,291,986 B2 * 10/2012 Gorrara ..... E21B 43/103 166/207

(Continued)

FOREIGN PATENT DOCUMENTS

GB 2383361 A 6/2003
GB 2398312 8/2004

(Continued)

*Primary Examiner* — Brad Harcourt
(74) *Attorney, Agent, or Firm* — Jeffery R. Peterson

(57) ABSTRACT

A tubular portion apparatus (10; 100; 300; 400) to be secured and sealed to another tubular (36) is described as is a method of securing and sealing a tubular portion (10; 100; 300; 400) to an existing downhole tubular (36) such as a casing string (36). The tubular portion (10; 100; 300; 400) comprises a central portion (14), an upper (16) and a lower (18) portion adjacent to the central portion (14) along a longitudinal axis of the tubular portion (10; 100; 300; 400). The tubular portion (10; 100; 300; 400) is formed from a main material and an additional material to strengthen the upper (16) and the lower (18) portion of the tubular portion (10; 100; 300; 400).

16 Claims, 6 Drawing Sheets

(56) References Cited

U.S. PATENT DOCUMENTS

| | | | | |
|---|---|---|---|---|
| 2004/0065445 | A1 | 4/2004 | Abercrombie Simpson et al. | |
| 2004/0123988 | A1 | 7/2004 | Cook et al. | |
| 2004/0231858 | A1 | 11/2004 | Waddell et al. | |
| 2005/0016740 | A1* | 1/2005 | Aldaz | E21B 33/1246 166/387 |
| 2006/0000617 | A1* | 1/2006 | Harrall | E21B 33/126 166/380 |
| 2007/0000664 | A1 | 1/2007 | Ring et al. | |
| 2010/0147535 | A1* | 6/2010 | Gorrara | E21B 43/103 166/382 |

FOREIGN PATENT DOCUMENTS

| | | | |
|---|---|---|---|
| WO | WO 01/18353 | A1 | 3/2001 |
| WO | WO 03/004820 | A2 | 1/2003 |
| WO | WO 2007/119052 | A1 | 10/2007 |

* cited by examiner

APPARATUS AND A METHOD FOR SECURING AND SEALING A TUBULAR PORTION TO ANOTHER TUBULAR

The present invention relates to an apparatus and a method for securing and sealing a tubular portion to another tubular. The apparatus and method are particularly suited for use in oil and gas wells. More particularly, the apparatus can be used as a liner hanger or a mid string casing packer or (by combining two such apparatus separated by a tubular portion) a straddle packer.

Oil and gas wells are conventionally drilled using a drill string to create a subterranean borehole. After drilling, the borehole is usually completed by running in a casing/liner string that is typically cemented in place. Additional liner strings may be required to be installed or coupled to the initially installed casing string in order to extend the reach of the completed borehole. This is conventionally achieved using liner hangers to couple additional liner strings to the lower end of the existing casing or liner string in the borehole. The liner hangers typically use mechanically or hydraulically set slips to bite into the existing casing. Furthermore, a packer is usually also used to provide a fluid tight seal at the location of the liner hanger to prevent fluid, in particular, gas ingress.

Conventional liner hangers can have problems, particularly when setting in "worn" casing which may have a non-uniform internal surface as it can be difficult to achieve the required quality of seal with such conventional liner hangers because they may not be able to expand compliantly against such an internal surface.

Recently, an alternative liner hanger has been developed and is disclosed in European Patent Publication No EP2013445. It is an object of embodiments of the present invention to provide further alternative tubular apparatus for securing and sealing to another tubular.

According to an aspect of the present invention, there is provided a tubular portion apparatus to be secured and sealed to another tubular, the tubular portion comprising:—

- a central portion;
- an upper and a lower portion adjacent to the central portion along a longitudinal axis of the tubular portion;
- a main material; and
- an additional material to strengthen the upper and the lower portion of the tubular portion.

Typically, the additional material strengthens the upper and the lower portion relative to the central portion.

The apparatus may comprise a securing and sealing means for securing the tubular portion to the existing tubular to thereby extend the length of the existing tubular and simultaneously provide a sealed coupling between the tubular portion and the said tubular.

Preferably, the apparatus provides a means to hang a new tubular portion, such as a liner string from a previously installed, existing tubular, such as a cemented casing string or a cemented liner string and therefore acts as liner hanger.

The inner and/or outer diameters of the central portion and/or the upper and/or the lower portions may have a substantially uniform sidewall thickness.

The additional material may be formed, e.g. welded or clad, to an inner surface of the tubular portion in the region of the upper and the lower portion. The additional material is preferably stronger than the main material of the tubular portion, e.g. not as easy deformable as the main material.

At least one annular seal may be provided on an outer surface of the tubular portion.

An outer surface of the tubular portion may have an annular recess in the region of the central portion. Thereby, a reduction in an outer diameter of the tubular portion is formed at the position of the annular recess at the central portion.

The outer diameter of the tubular portion may be tapered from the ends of the tubular portion to the centre of the tubular portion such that the thickness of the tubular portion is least at the centre and greatest at the ends.

An outer diameter of the tubular portion may be enlarged at each end portion of the tubular portion to provide a thicker sidewall portion of the tubular portion.

Alternatively, the outer diameter may be enlarged in a region of the upper and lower portion of the tubular portion or both at each end of the central portion and in the region of the upper and lower portion of the tubular portion, such that it protrudes an outer diameter of the central portion of the tubular portion.

The outer diameter may be enlarged by forming a separate piece of material, e.g. steel, to the main material at the said outer diameter.

Alternatively, the outer diameter may be enlarged by using a thicker raw material for the end portions and/or the upper and the lower portion of the tubular portion.

At least one annular seal may be provided in the region of the upper and/or the lower portion of the tubular, or in the region of the central portion of the tubular. For example, when the outer diameter is uniform at the central portion and the upper portion and the lower portion of the tubular, or recessed in the central portion, one annular seal may be provided on the outer surface of the upper portion and another annular seal may be provided on the outer surface of the lower portion. When the outer diameter is enlarged at the end portions and/or the upper and the lower portions of the tubular portion, then at least one annular seal may be provided in the region of the central portion of the tubular portion.

The diameter of the tubular portion can preferably be expanded by means of an expansion tool as disclosed in International Patent Application No WO2007/119052, which is incorporated herein by reference. The tubular portion can be radially expanded using a hydraulically operated expansion tool. The expansion tool can be arranged to sealingly engage with an inner diameter of the tubular portion at two axially spaced locations. The expansion tool can be arranged to engage with the inner diameter of the tubular portion in a region of the upper and the lower portion of the tubular portion. Typically, the expansion tool can be arranged to engage with the inner diameter of the tubular portion in a region of the additional material formed on or to the inner surface of the upper portion and the lower portion of the tubular portion.

The expansion tool can be capable of applying a fluid pressure within the tubular portion in the area between the points of engagement of the expansion tool and the inner diameter of the tubular portion. The fluid pressure can cause the tubular portion to radially expand. The tubular portion can initially expand in the region of the central portion, and subsequently in the region of the upper and the lower portion.

The tubular portion and the other, existing tubular to which the tubular portion may be secured and sealed may be expandable to form at least one shoulder portion. Two or more shoulder portions can be provided and the part of tubular therebetween can have a greater outer diameter than the tubular portion and the other tubular outwith the region between the shoulder portions. The expansion tool can be arranged to radially expand the tubular portion and the existing tubular. The expansion tool can be arranged to radially expand the tubular portion such that plastic deformation of the tubular portion is experienced. The expansion tool can be arranged to radially expand the tubular portion into the existing tubular such that elastic deformation and optionally plastic deformation of the existing tubular is experienced. The expansion tool can create two annular shoulders in a region that the expansion tool seals against the inner diameter of the tubular portion. Typically, the tubular portion and the existing tubular are at least in part in interfacial contact in the region of each shoulder. This has the effect of securing the tubular portion to the existing tubular. The interfacial contact between the tubular portion and the existing tubular along the radially expandable part of the tubular preferably creates a fluid tight seal.

At least one seal can be provided in an annular groove within the outer surface or on the outer surface of the tubular portion and typically, the at least one seal will stand proud of the outer diameter of the rest of the outer surface of the tubular portion.

The at least one seal can be positioned in a recess formed around the outer circumference of the tubular portion such that when the tubular portion is fully expanded, the metal of the tubular portion on each side of the at least one seal is in direct contact with the metal of the other tubular, providing metal to metal contact and typically reducing the extrusion gap to zero.

Alternatively or additionally, further securing and sealing means can be provided on an outer surface of the tubular portion. The securing and sealing means could in certain embodiments be provided simply by the outer surface of the tubular portion. However, the securing and sealing means can preferably comprise a roughened part of the outer surface of the tubular portion to enhance the grip of the tubular portion on the pre-existing tubular. At least part of an outer surface of the tubular portion can be coated with an elastomeric material to aid sealing. The securing or sealing means can comprise a profile applied to an outer surface of the tubular portion.

Additional elastomeric material preferably in the form of one or more elastomeric band(s) can be positioned along the length of the tubular portion incorporating a fluid exclusion path that will ensure that fluid is not trapped by the elastomer band(s). The higher coefficient of friction of the elastomer material of the one or more band(s) in contact with the metal will cause the load carrying capacity of the apparatus to be increased.

According to the aspect of the present invention, there is provided a method of securing and sealing a tubular portion to another tubular, the method comprising the steps of:

- providing a tubular portion having a central portion and an upper portion and a lower portion adjacent to the central portion along a longitudinal axis of the tubular portion;
- providing the tubular portion made of a main material and including an additional material to strengthen the upper and the lower portion of the tubular portion;
- simultaneously securing and sealing the tubular portion to the said tubular, thereby extending the length of the said tubular.

The method may include providing a tubular portion according to some or any of the features described in relation to the tubular portion apparatus according to the first aspect of the present invention.

The method can include radially expanding at least a part of the tubular portion to secure and seal the tubular portion to the said tubular.

The method can include running an expansion tool into the tubular portion and engaging the inner diameter of the tubular portion and expanding at least a part of the tubular portion using the expansion tool.

The method can include engaging the inner diameter of the tubular portion in a region of the upper and the lower portion.

The method can include applying a fluid pressure within the tubular portion and thereby radially expanding at least part of the tubular portion.

The method can include applying fluid pressure to the inner surface of the tubular portion, thereby causing a radial expansion of the central portion, followed by a radial expansion of the upper and the lower portion.

The method can extend the length of a tubular and can simultaneously provide a sealed coupling between the tubular portion and the said tubular, thereby providing a method of hanging a new tubular portion from a previously installed, existing tubular, such that a liner hanger is provided.

The method can include radially expanding the tubular portion and the adjacent existing tubular, e.g. a casing, such that there is residual interfacial contact between the tubular portion and the existing tubular once the fluid pressure is removed.

The method can include providing at least two axially spaced annular seals on an outer surface of the tubular portion and expanding part of the tubular portion between the seals and subsequently expanding the tubular portion in the region of the seals. Typically, at least two axially spaced annular seals are arranged to stand proud of the outer surface of the tubular portion that is at either side of the respective axially spaced annular seal.

The method can include roughening at least a part of the outer surface of the tubular portions and thereby improving the grip of the tubular portion. The method can include machining a profile on an outer surface of the tubular portion to enhance the grip of the tubular portion on the existing tubular in use.

With the tubular portion apparatus in use as a liner hanger, it would typically be installed at the upper end of a liner string. The liner is typically deployed into the well initially inside of a casing string and then possibly into open bore hole. The liner hanger is typically always inside the casing. The liner may then be cemented in place, and the liner hanger would be hydraulically expanded into the casing. Once set, the liner hanger provides a pressure seal and bi-directional load bearing capability.

Another application for use of the tubular portion apparatus is as a mid-string casing packer and in such an application it would typically be installed at one or more (for instance three or four) locations spaced apart along the length of a casing string and the casing string is typically deployed into the well inside of an already existing but possibly damaged older casing string such that there is then a pair of casing strings in a co-axial arrangement with one another, where the one or more tubular portion apparatus are spaced apart along the inner of the two casing strings. In other words, its use as a mid-string packer differs from a liner hanger in that with the former, it is installed in a length of a casing which extends in both directions. With the inner casing deployed in its final position, the individual mid-string casing packers are each available for expansion against the inner surface of the outer casing string by the hydraulic expansion tool acting to expand each packer in turn. Once set, the one or more mid-string casing packers provide both a pressure seal and a bi-directional load bearing capability. In other words, the mid-string casing packers provide a bi-directional anchor but also form a pressure seal against the outer casing preventing the migration of fluid in the annulus between the two casing strings from passing either up or down.

Another application for use of the tubular portion apparatus is where two are used together but separated by a section of regular tubular, such an arrangement combining to provide a straddle packer that straddles e.g. a section of worn or damaged casing that has lost its integrity and so may be leaking or some other section that requires to be straddled.

An advantage of the present invention is that, due to the additional, strengthening material provided at the upper and the lower portions, the tubular portion is adapted or arranged to expand at the central portion prior to the upper and the lower portion when a pressure is applied to an inner surface of the tubular portion. This is because the central portion is, in effect, weaker in relation to its ability to withstand radial expansion forces than the upper and the lower portions and thus the pressure has a greater expansion effect on the central portion and therefore expands preferably to the strengthened upper and lower portions. Thus, any fluid between the tubular portion apparatus and another tubular, e.g. the outer casing, is expelled during the expansion process before the seals come into contact with the other tubular. Fluid can therefore not be trapped between seals, which may be located on the outer surface of the tubular portion at either end of the tubular portion or in a region of the upper and the lower portion, an outer diameter of the tubular portion and an inner diameter of the other tubular. Thus, an occurrence of a "hydraulic lock" situation can be minimized, in which the fluid (which is trapped by the seals and is inherently not very compressible would prevent full expansion of the tubular portion apparatus. Full expansion is however necessary to affect a fully energised seal and axial load bearing capability.

Additionally, a great advantage of embodiments of the present invention are that the tubular portion apparatus will expand compliantly into the inner surface of the throughbore of an existing casing section and that is a great advantage if the existing casing section is worn (i.e. if the existing casing section does not have a uniform internal diameter) because the compliant expansion of embodiments of the present invention will provide a much higher quality of seal with such a worn casing section.

Additionally, embodiments of the present invention also have the advantage to provide the ability of tailoring the expansion pressure provided by the expansion tool through the use of finite element (FE) modelling and this ensures that the tubular portion apparatus can be expanded and set at a lower pressure if required so that damaged or worn casing is not burst. This simply wouldn't be possible with conventional liner hangers or casing packers.

Embodiments of the present invention will be described with reference to and as shown in the following Figures, in which:—

Figure 1:
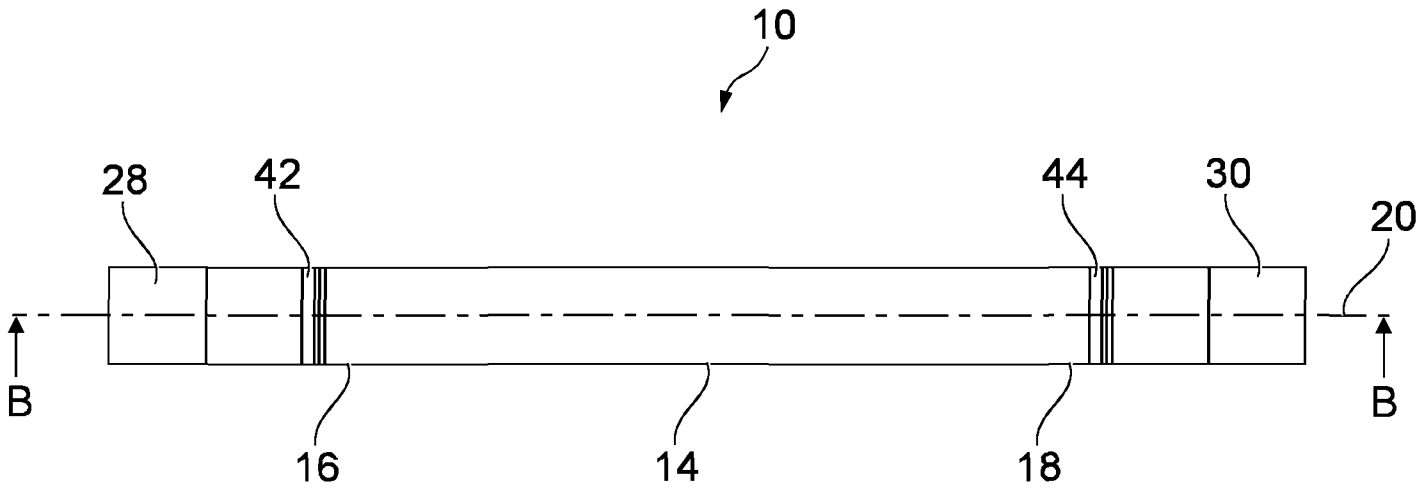
FIG. 1 is an external side view of a first embodiment of a tubular portion apparatus according to the present invention.
Figure 2:
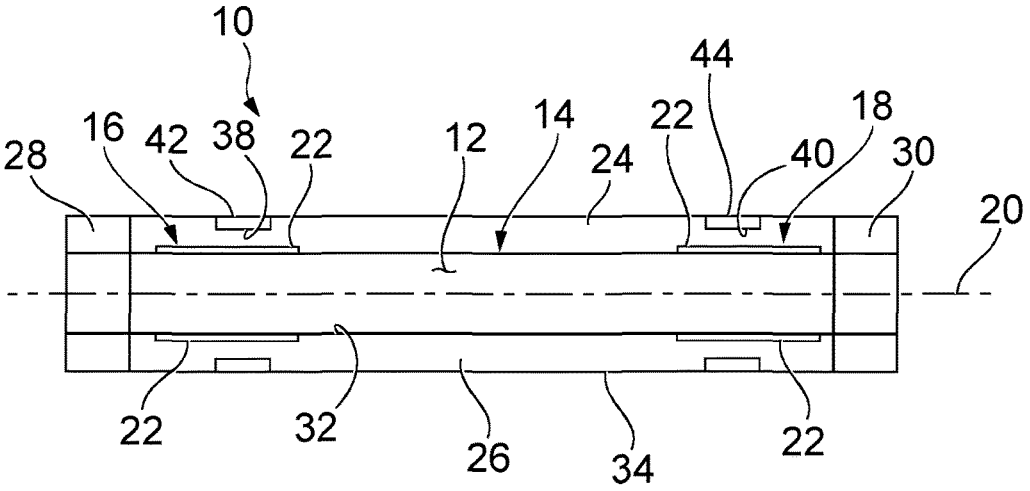
FIG. 2 is a sectional view of the tubular portion apparatus of FIG. 1 along the line B-B.
Figure 5A:
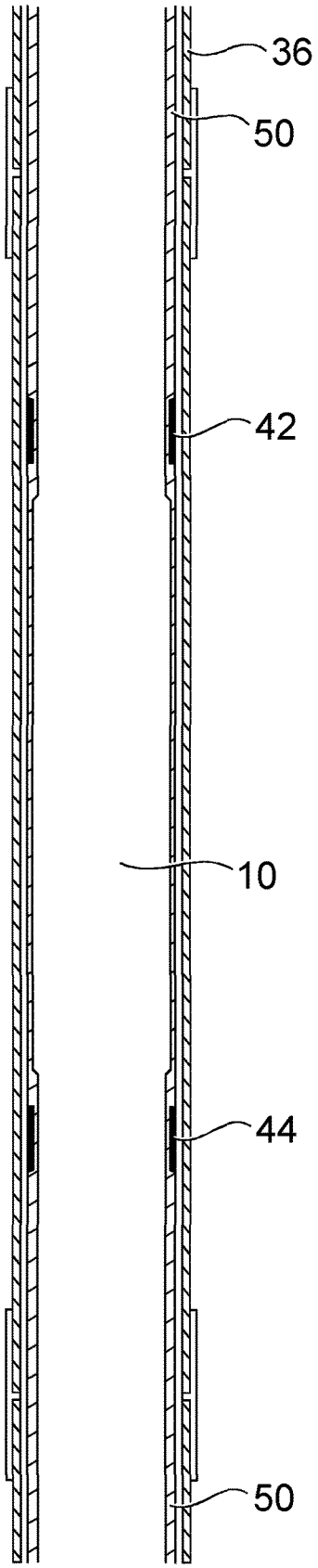
Figure 5B:
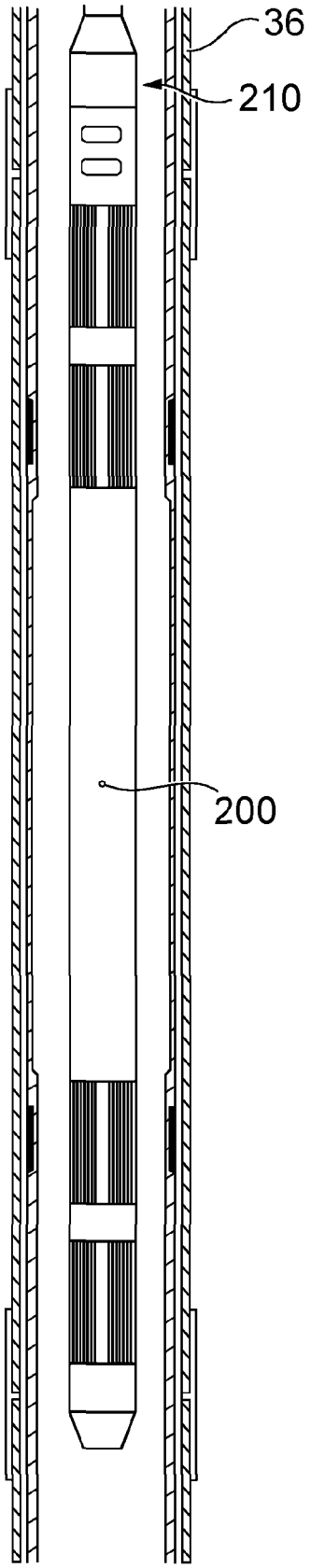
Figure 5C:
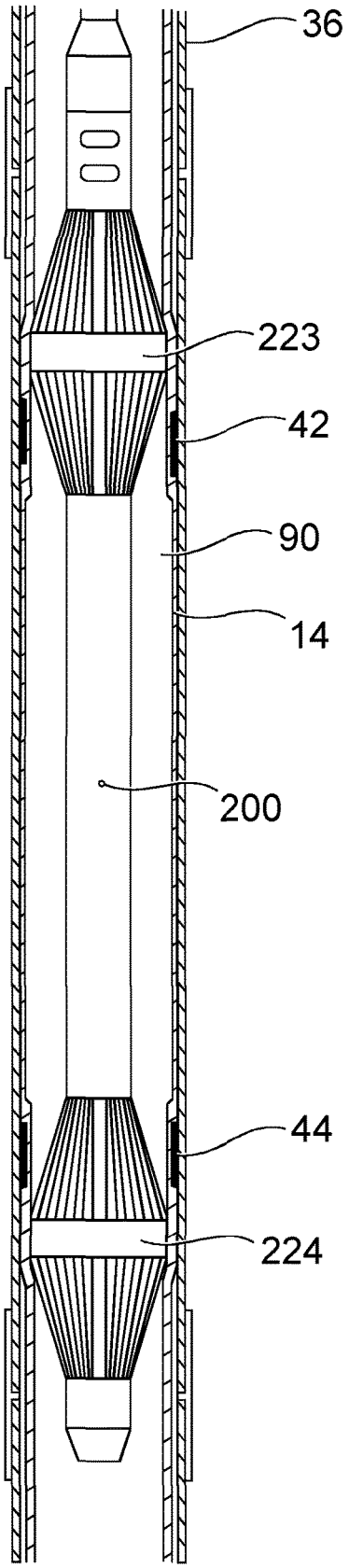
Figure 6:
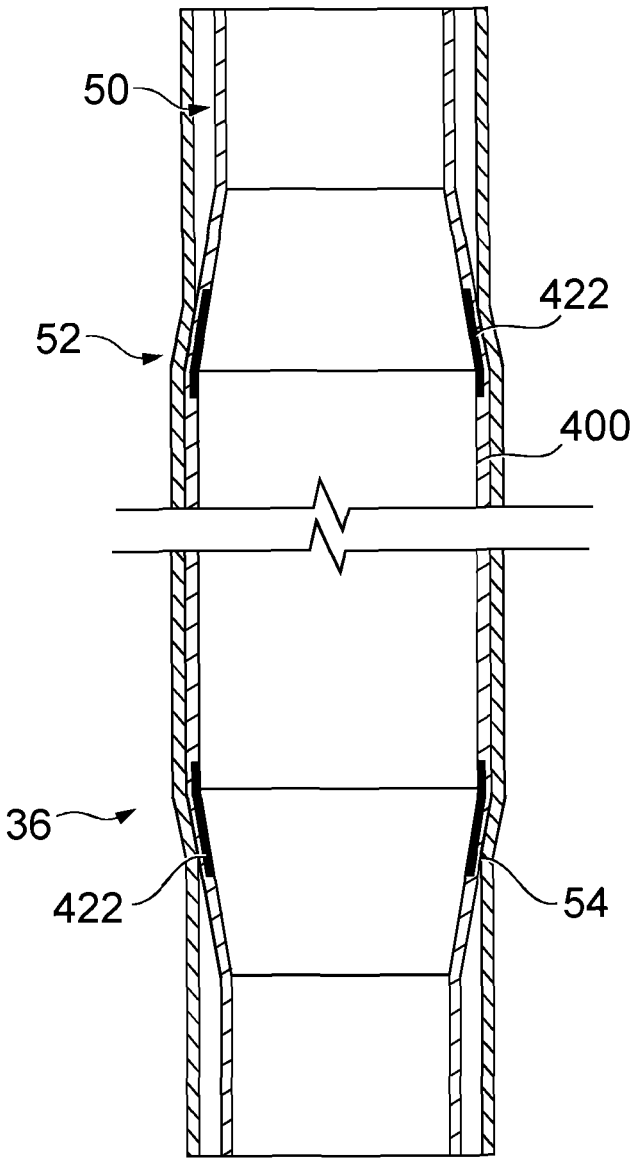

FIG. 5*a* is a sectional view of the tubular portion apparatus of FIG. 1 and FIG. 2 within a casing string;

FIG. 5*b* is a part sectional view of the tubular portion apparatus of FIG. 1 and FIG. 2 and an expansion tool in a running-in configuration, being run into the throughbore of the casing string and the tubular portion apparatus;

FIG. 5*c* is a part sectional view of the tubular portion apparatus being expanded by the expansion tool to thereby seal it to the casing string; and FIG. 6 is a sectional view of apparatus according to another embodiment of the invention.

A tubular portion apparatus in the form of a liner hanger or mid-string casing packer or of one end of a straddle packer (hereinafter just referred to as liner hanger) is shown generally at 10 in FIG. 1. As shown in the sectional view of the liner hanger 10 in FIG. 2, the liner hanger 10 is a tubular having a throughbore 12 and comprising a central portion 14 and an upper 16 and a lower 18 portion adjacent to the central portion 14 along a longitudinal axis 20 of the liner hanger 10. The liner hanger 10 has a substantially uniform sidewall thickness on both the inner and outer surface thereof along the central portion 14 and the upper 16 and the lower 18 portion. A recess if formed on an inner surface of both the upper 16 and the lower 18 portion, and an additional material 22 is clad or welded into each of the recesses such that it is permanently secured to the main material 24 of which the main body of the liner hanger 10 consists. The additional material 22 is stronger than the main material 24 with respect to elastic and plastic deformation. The main material 24 is typically made from relatively low strength and high ductility alloy such as 316L stainless steel and the additional material is typically made from a relatively stronger material that has a certain extent of ductility, such as Inconel® 625 or other suitable material. The upper 16 and the lower 18 portions are thus strengthened by the additional material 22. Consequently, the liner hanger 10 is adapted to expand in the central region 14 prior to the upper 16 and lower 18 portions, as will be described subsequently. The liner hanger 10 also comprises end portions 28, 30 which are typically formed from a relatively higher strength material such as a carbon steel welded to the respective ends of the main material 24 and into which a thread can be cut. Typically, the welded junction between the relatively stronger end portions 28, 30 and relatively weaker central portion 14 is arranged to be outside of the area that will be sealed against and therefore outside the area into which highly pressurised fluid will be pumped, as will be described subsequently, during expansion of the central portion 14.

An inner 32 and an outer 34 surface of the liner hanger 10 have respective substantially uniform inner and outer diameters. In order to provide a gas tight seal between the liner hanger 10 and an existing tubular or casing 36 (FIG. 5*a*) into which the liner hanger 10 is to be expanded, the outer surface of the liner hanger 10 is provided with two annular grooves 38, 40 in the region of the upper 16 and the lower 18 portion. Each groove 38, 40 accommodates an annular seal 42, 44. The annular seals 42, 44 are also shown in FIG. 1 on the outer surface of the liner hanger 10. The annular grooves 38, 40 and/or the annular seals 42, 44 can also be omitted. For example, the annular grooves 38, 40 may be omitted if the annular seals 42, 44 are to be provided directly on the outer surface 34 of the liner hanger 10 without being sunk into grooves 38, 40. Alternatively, the annular seals 42, 44 may be omitted if for some reason a gas tight seal is not required. Preferably, the outer diameter of each seal 42, 44 is arranged or adapted to stand proud of the outer diameter of the liner hanger 10 either side of the respective annular grooves 38, 40.

Figure 3:
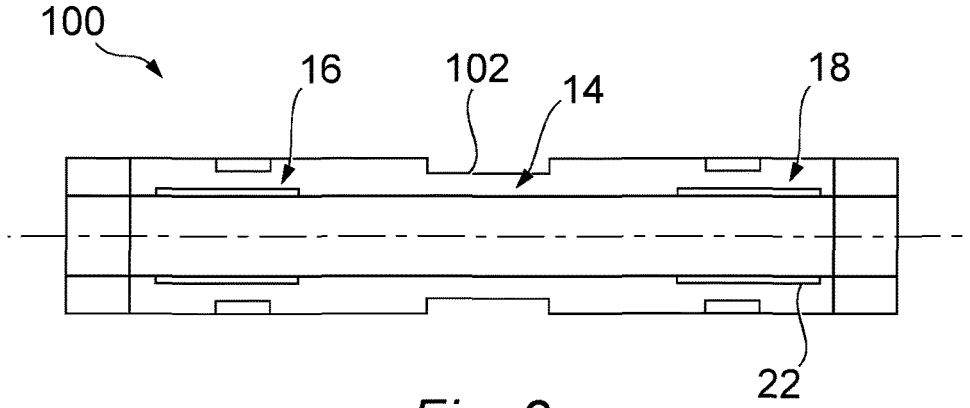
FIG. 3 is a sectional view of a second embodiment of a tubular portion apparatus according to the present invention.

FIG. 3 shows another embodiment of a liner hanger or mid-string casing packer or of one end of a straddle packer (hereinafter just referred to as liner hanger) 100, which is relatively similar to the embodiment shown in FIG. 2, and the same reference numbers have been used for corresponding parts. The liner hanger 100 of FIG. 3 differs from the liner hanger 10 of FIG. 2 in that the outer diameter of the liner hanger 100 is reduced in a region of the central portion 14 of the liner hanger 100. Thereby, an annular recess 102 is formed in the outer surface 34 of the liner hanger 100 in this part of the central portion 14. The reduced sidewall thickness of the liner hanger 100 in at least a part of the central portion 14 results in an enhancement of the differential strengthening effect that is achieved by the strengthened upper and lower portion 16, 18. The upper 16 and the lower 18 portion are now even stronger than the central portion 14 as compared to the liner hanger 10 shown in FIG. 2. The liner hanger 100 will even more preferably expand in a region of the annular recess 102 of the central portion 14 first, and only after that expand in the region of the upper and the lower portion 16, 18.

Figure 4:
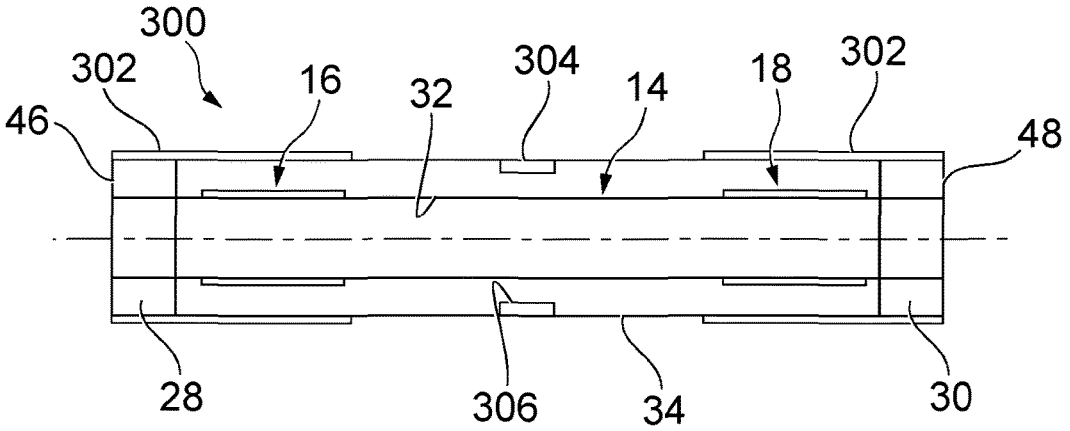
FIG. 4 is a sectional view of a third embodiment of a tubular portion apparatus according to the present invention.

A further embodiment of a liner hanger or mid-string casing packer or of one end of a straddle packer (hereinafter just referred to as liner hanger) 300 is shown in FIG. 4 and the same reference numbers have been used for corresponding parts to those of FIGS. 1 to 3. The liner hanger 300 differs from the liner hangers 10, 100 shown in FIG. 2 and FIG. 3 in that it provides a separate piece of material 302, typically formed from either the same material as central portion 14 (i.e. stainless steel or the like) or from a stronger material such as carbon steel or Inconel® depending upon how much expansion an operator wishes to inhibit, in the form of a sleeve 302 which extends from each end 46, 48 of the liner hanger 300, over the end portions 28, 30, into a region of the upper 16 and the lower 18 portion of the liner hanger 300. Alternatively, the sleeves 302 may be integral with the central portion 14. Thus, the outer diameter of the liner hanger 300 is greater at the end portions 28, 30 and in the region of the upper 16 and the lower 18 portion than in the central portion 14. This also results in promoting an expansion of the central portion 14 prior to an expansion of the upper 16 and the lower 18 portion, when a pressure is applied to the inner surface 32 of the liner hanger 300, as will be described subsequently in more detail. The liner hanger 300 has an annular seal 304 on the outer surface 34 which is located in a groove 306 at the central portion 14 where the annular seal 304 will typically stand proud of the outer diameter of the liner hanger 300. When the liner hanger 300 is expanded (described subsequently), the annular seal 304 will be the first part of the liner hanger 300 contacting the existing tubular or casing 36 (FIG. 5*a*). At the time the annular seal 304 contacts the inner surface of the casing 36, the annular seal 304 seals off an unwanted but potential fluid passage way and thereby prevents any fluid located between the outer diameter of the liner hanger 300 and the inner diameter of the casing 36 to pass across the central portion 14 from the upper to the lower portion 16, 18 or vice versa. Instead, the fluid will be displaced in the direction of each end portion 28, 30 of the liner hanger 300. The annular central seal 304 may also provide a certain extent of load bearing capability.

The liner hangers 10, 100, 300 are expandable using a suitable expansion tool 210, such as the hydraulic expansion tool 210 described in United Kingdom Patent No GB2398312B and corresponding foreign applications, or in International PCT Patent Application Number WO2007/119052, the full contents of which are incorporated herein by reference. The expansion tool 210 enables the containment of hydraulic pressure to a specific area in the well and the ability to generate up to 2500 bar controllably to expand a tubular elastically and plastically until it conforms with the outer tubular.

Before use of the apparatus according to the invention, a borehole is drilled out and a casing string 36 run-in and cemented in place as shown in FIG. 5*a*. The liner hanger 10 is connected, typically via threaded connections, to the upper end of a liner string 50 of similar outer diameter to the liner hanger 10 and having a smaller outer diameter than the inner diameter of the installed casing 36. At a leading (lower) end of the liner string 50, a drill bit (not shown) is provided. The liner string 50 is run into the wellbore through the throughbore of the casing 36 and is rotated downhole or/and from surface such that the drill bit is used to extend the borehole further; this operation is known in the art as "drilling with casing" or "drilling with liner" or "casing while drilling". Drill fluid is circulated up the annulus between the outer diameter of the liner string 50 and the installed casing 36. Once the drill bit has reached its required depth drilling ceases, the drill bit and bottom hole assembly is retrieved, the casing 36 can be cemented in place and the liner hanger 10 is correctly positioned towards a lower end of the installed casing 36. The hydraulic expansion tool 210 is run into the wellbore through the throughbore 24 of the liner string 50 in its running-in configuration as shown in FIG. 5*b*. The expansion tool 210 may be correctly positioned with respect to the liner hanger 10 using a depth latch system or a gamma ray tool with radioactive pip tags.

Once the expansion tool 210 reaches the liner hanger 10, the tool 210 is located such that the seals 223, 224 are adjacent the inner diameter of the upper and the lower portion 16, 18 respectively with the central portion 14 therebetween. The expansion tool 210 is hydraulically actuated. A compressive force is applied to the tool 210 using a displacement means. The compressive force causes a downwardly directed displacement of a support sleeve which causes the respective annular seal 223, 224 to rise up a respective wedge member which causes the annular seal 223, 224 and the fingers of the respective support sleeves to expand radially. The expansion of the support sleeves and the corresponding movement of the seal assembly 223, 224 is shown in FIG. 5*c*. In this way, the annular seals 223, 224 expand to a larger radius. Accordingly, the expansion of the seal assemblies causes the seals 223, 224 to engage with the upper 16 and the lower 18 portion and the seals 223, 224 are now in the setting position shown in FIG. 5*c*.

Once in the setting position, hydraulic fluid is directed under pressure from the surface to the tool 210 from where it is fed via a port 200 to an annulus 90 between the tool 210 and the liner hanger 10 and the innermost facing surfaces of the annular seals 223, 224. The application of this fluid pressure on the inner surface of the liner hanger 10 causes radial expansion of the central portion 14 initially since the upper 16 and lower 18 portion are strengthened by the additional material 22 being stronger than the material 24 of the central portion 14 according to the first embodiment shown in FIG. 2, which encourages the central portion 14 of the liner hanger 10 to radially expand prior to the expansion of adjacent upper 16 and lower 18 sections. The central portion 14 is also adapted to radially expand prior to the expansion of adjacent sections in the second embodiment of the liner hanger 100 shown in FIG. 3 due to the annular recess 102 of the outer diameter in a region of the central portion 14 in addition to the additional material 22, so that the annular recess 102 further reduces the strength of the central portion 14 as compared to the upper 16 and lower 18 portions. Also, in the third embodiment of the liner hanger 300 shown in FIG. 4, the separate pieces of material 302 provided on the outer surface 34 in the region of the upper 16 and lower 18 portion, in addition to the additional material 22 on the inner surface 32 of the liner hanger 300, lead to a radial expansion of the central portion 14 prior to the expansion of adjacent sections. Following expansion of the central portion 14, the upper 16 and the lower 18 portion begin to expand. Throughout the liner hanger 10 expansion, the fingers of the support sleeves of the expansion tool 210 are activated at a pre-set pressure ahead of the pressure in the annulus 90. The pressure of fluid from the hydraulic source entering the annulus 90 is controlled via a differential pressure valve (not shown) to reduce the pressure from the hydraulic source. Hence, the pressure acting on the seal assemblies 215 is greater than the pressure of the annulus 90 by the predetermined amount e.g. 2000 psi so as to maintain the hydraulic seal without deforming the seal areas of the liner hanger 10 prior to the central portion 14 of the liner hanger 10.

One advantage of the initial expansion of the central portion 14 is that substantially all liquid between the outer surface of the liner hanger 10 and the casing 36, for example, water, oil and/or drilling mud or wet cement is squeezed out of the annulus between the liner hanger 10 and the casing 36 before the seals 42, 44 engage the inner surface of the casing 36. The securing of the liner hanger 10 to the casing 36 is aided by the roughened outer surface of the central portion 14 to engage a greater proportion of surface area into contact with the inner surface of the casing 36.

The positioning of the seals 42, 44 of the liner hanger 10 in the region of the upper and the lower portions 16, 18 has the added advantage that the annular grooves 38, 40 on the outer surface of the liner hanger 10 (which accommodate the seals 42, 44) are not located in the region of liner hanger which is not strengthened by an additional material 22 and therefore the location of the seals 42, 44 does not represent a weak point of the liner hanger 10. However, the outer surface in the region of the central portion 14 may also or alternatively be coated in a sealing elastomer or such similar material to aid sealing.

The liner hanger 10 is expanded beyond its elastic limit such that plastic deformation of the liner hanger 10 is experienced. The force applied by the hydraulic fluid to the liner hanger 10 is such that there is a strong interfacial contact between the casing 36 and the liner hanger 10. As a result of continued application of fluid pressure, elastic deformation of the casing 36 is experienced. The elastic and plastic deformation of the casing 36 and the liner hanger 10 respectively causes a compressive force to be applied by the casing 36 to the liner hanger 10 thus improving the quality and strength of the interfacial seal. Deformation of the liner hanger 10 beyond its elastic limit ensures that the radially expanded liner hanger 10 remains in its radially expanded state once the hydraulic fluid pressure is removed. Thus, according to the preferred embodiment, the liner hanger 10 is expanded beyond its elastic limit to experience plastic deformation and the casing 36 is expanded up to its elastic limit but not beyond so that no plastic deformation of the casing 36 is experienced.

Once the liner hanger 10 has been secured to the casing 36, the annular seals 223, 224 are de-activated and are therefore retracted and thus, the expansion tool 210 is in its initial running-in configuration and can be pulled out of the wellbore.

According to another embodiment, both the liner hanger 10 and the casing 36 are expanded to create upper and lower annular shoulders to enhance the load capability of the liner hanger 10; these are shown in more detail and described with reference to FIG. 6.

An alternative liner hanger or mid-string casing packer or of one end of a straddle packer (hereinafter just referred to as liner hanger) 400 is shown in FIG. 6 expanded into contact with the casing 36. The liner hanger 400 differs from the liner hangers 10, 100, 300 described for the previous embodiment in that no elastomeric seals are provided on an outer surface thereof. The liner hanger 400 has upper and lower portions being clad with an additional, strengthening material 422 on an inner surface facing towards the through-bore of the liner hanger 400; the benefits of which were outlined with reference to the first described embodiment.

In FIG. 6, the liner hanger 400 has been expanded in the manner previously described to form a metal to metal seal. The plastic deformation of both the liner hanger 400 and the casing 36 results in the formation of an upper shoulder portion 52 and a lower shoulder portion 54 in the region of the respective seals 223, 224 of the expansion tool 210, at the outer extremity of the expanded part of the liner hanger 400. The shoulder portions 44, 45 have the advantage of enhancing the load capability of the liner hanger 400.

The apparatus and the method of the present invention provide a way of securing and sealing a liner hanger to existing casing without the need for slips or moving parts and is achievable in a one step process. Furthermore, the apparatus and the method of the present invention provides the significant advantage of the liner hanger or mid-string casing packer or of one end of a straddle packer (hereinafter just referred to as liner hanger) 10, 100, 300, 400 providing a relatively high expansion ratio (i.e. its final expanded diameter compared to its unexpanded diameter) which leads to the possibility of it having a relatively small unexpanded outer diameter and therefore a lower equivalent circulating density (ECD) when used in wells with depleted zones. The reason for this is that, with conventional liner hangers that have a larger unexpanded outer diameter, they necessarily result in a small annular clearance and therefore there is a higher ECD and that can lead to excessive pressure of fluid acting against the formation causing it to fracture or just absorb the liquid (i.e. can cause lost circulation). Accordingly, it is advantageous to be able to lower the ECD by increasing the annular clearance between the outer surface of the liner hanger or mid-string packer/straddle packer and the inner surface of the outer existing tubular and if that is possible then the disadvantages mentioned above are less likely to happen. Consequently, the embodiments of the present invention that have a relatively high expansion ratio will likely have significant advantages in this regard.

Furthermore, embodiments of the present invention of liner hanger/mid-string casing packer/straddle packer 10, 100, 300, 400 have the advantage over existing conventional liner hangers that they can be run and only require to be set if they are required because the liner hanger 10, 100, 300, 400 is a passive component that will not be set by accident because it requires a specific expansion tool 210 to be run in to set it.

Furthermore, embodiments of the present invention can be used as either a liner hanger, a mid-string casing packer or straddle packer and can be used as an anchor against thermal expansion to prevent relative movement in the string occurring. Furthermore, they have the advantage of providing relatively high expansion ratios and a relatively low ECD and can be run and not set unless required and can therefore act as a contingency annular barrier. Furthermore, there is no possibility of an accidental setting occurring with embodiments of the present invention. Furthermore, embodiments of the present invention are hydraulically set and therefore can compliantly conform to the outer tubular and they provide an expandable metal to metal seal and also provide the advantage of the possibility of expanding each separate liner hanger or mid-string casing packer 10, 100, 300, 400 individually and therefore the string can be expanded in stages. Furthermore, embodiments of the present invention provide the possibility of tailoring the expansion pressure to suit the application (for example weak or worn existing casing). Furthermore, embodiments of the present invention have the advantage of straddle packer conveyance and can be run and cemented in one trip with an annular setting tool and have compatibility with both the string they run in on and also the casing they are to be set against because embodiments of the present invention can be designed to suit the particular conveyance.

Modifications and improvements can be made without departing from the scope of the invention. According to other embodiments of the invention, any number of annular seals 42, 44 can be provided in one or more annular grooves.

Also, the outer diameter of the tubular portion may be tapered from the ends of the tubular portion to the centre of the tubular portion such that the thickness of the tubular portion is least at the centre and greatest at the ends. Furthermore, the outer diameter of the tubular portion may be tapered from a largest or greatest thickness at the each of the upper 16 and lower 18 portions to the centre of the tubular portion such that there is no length of substantially identical side wall thickness in the centre section or central portion 14 of the liner hanger. Furthermore, the liner hanger 10 could be modified such that it is tapered from one end having a largest side wall thickness all the way to the other end having a smaller side wall thickness. Such a tapered arrangement from one end to the other provides the advantage that the tubular portion apparatus would expand progressively from one end to the other, causing the fluid to be squeezed out of the annulus as it expands. Additionally, more elastomer bands may be used to increase friction and/or the elastomer bands may have grooves formed in them on their outer surface or the elastomer may be in a pad format that does not provide a continuous band around the outer circumference of the tubular portion apparatus and/or the elastomer may be continuous along a significant length of the outer circumference of the tubular portion apparatus.

We claim:

1. A tubular portion apparatus to be secured and sealed within another tubular, the tubular portion apparatus comprising:— a central portion;

an upper and a lower portion adjacent to and on either side of the central portion along a longitudinal axis of the tubular portion, said tubular portion adapted to be radially expanded by the application of fluid pressure to an inner surface of said tubular portion;

the central, upper and lower portions formed of a main material; and the upper and lower portions comprising an additional material positioned within a recess therein to strengthen the upper and the lower portions of the tubular portion, whereby upon the application of sufficient fluid pressure to said inner surface of said tubular portion, said central portion radially expands before said upper and lower portions radially expand, wherein an outer diameter of the tubular portion is enlarged at each end portion of the tubular portion to provide a thicker sidewall portion of the tubular portion.

2. The tubular portion apparatus of claim 1, wherein the additional material is a separate piece of material formed to an inner surface of the tubular portion in the region of the upper and the lower portion.

3. The tubular portion apparatus of claim 1, wherein the additional material is stronger than the main material of the tubular portion, thereby yielding a greater resistance to radial expansion than said central portion for the same dimensions.

4. The tubular portion apparatus of claim 1, wherein at least one annular seal is provided on an outer surface of the tubular portion.

5. The tubular portion apparatus of claim 1, wherein an outer surface of the tubular portion has an annular recess in the region of the central portion to provide a reduction in a portion of an outer diameter of the central portion at the position of the annular recess.

6. The tubular portion apparatus of claim 5, wherein the outer diameter is enlarged by forming a separate piece of material to the main material within said annular recess at the said outer diameter.

7. The tubular portion apparatus of claim 5, wherein the outer diameter on either side of said annular recess is enlarged by using a thicker raw material for the end portions and/or the upper and the lower portion of the tubular portion.

8. The tubular portion apparatus of claim 1, wherein at least one seal is provided in an annular groove within the outer surface or on the outer surface of the tubular portion wherein the at least one seal comprises a greater depth or thickness than the depth of the recess such that the at least one seal stands proud of or has a greater outer diameter than the outer diameter of the rest of the outer surface of the tubular portion.

9. The tubular portion apparatus of claim 8, wherein further securing and sealing means are provided on an outer surface of the tubular portion, the further securing and sealing means comprising one or more elastomer bands positioned along the length of the tubular portion, the one or more elastomer bands incorporating a fluid exclusion path that ensures that fluid is not trapped by the one or more elastomer bands.

10. A tubular portion apparatus to be secured and sealed within another tubular, the tubular portion apparatus comprising:— a central portion;

an upper and a lower portion adjacent to and on either side of the central portion along a longitudinal axis of the tubular portion, said tubular portion adapted to be radially expanded by the application of fluid pressure to an inner surface of said tubular portion;

the central, upper and lower portions formed of a main material; and the upper and lower portions comprising an additional material positioned within a recess therein to strengthen the upper and the lower portions of the tubular portion, whereby upon the application of sufficient fluid pressure to said inner surface of said tubular portion, said central portion radially expands before said upper and lower portions radially expand, wherein an outer diameter of the tubular portion is tapered from the ends of the tubular portion to the centre of the length of the tubular portion such that the thickness of the tubular portion is least at the centre and greatest at the ends.

11. The tubular portion apparatus according to claim 10, wherein the outer diameter of the tubular portion is tapered all the way from each of the ends to the centre of the length of the tubular portion.

12. A method of securing and sealing a tubular portion within an existing downhole tubular, the method comprising the steps of:

providing a tubular portion having a central portion and an upper portion and a lower portion adjacent to and on either side of the central portion along a longitudinal axis of the tubular portion;

providing the tubular portion made of a main material and including an additional material positioned within a recess within said upper and lower portion to strengthen the upper and the lower portion of the tubular portion, whereby said central portion will radially expand before said upper and lower portions radially expand, upon the application of sufficient fluid pressure on an inner surface of said tubular portion; and simultaneously securing and sealing the tubular portion to the said existing downhole tubular, further comprising radially expanding at least a part of the tubular portion to secure and seal the tubular portion to the said existing downhole tubular, and wherein at least one seal is provided in an annular groove within the outer surface or on the outer surface of the tubular portion wherein the at least one seal comprises a greater depth or thickness than the depth of the recess such that the at least one seal stands proud of or has a greater outer diameter than the outer diameter of the rest of the outer surface of the tubular portion, and wherein further securing and sealing means are provided on an outer surface of the tubular portion, the further securing and sealing means comprising one or more elastomer bands positioned along the length of the tubular portion, the one or more elastomer bands incorporating a fluid exclusion path that ensures that fluid is not trapped by the one or more elastomer bands.

13. The method of claim 12, comprising applying fluid pressure to the inner surface of the tubular portion, thereby causing a radial expansion of the central portion, followed by a radial expansion of the upper and the lower portion.

14. The method of claim 13, comprising radially expanding the tubular portion and the adjacent existing downhole tubular such that there is residual interfacial contact between the tubular portion and the existing downhole tubular once the fluid pressure is removed.

15. The method of claim 12, wherein the method provides an extension to the length of an existing downhole tubular and simultaneously provide a sealed coupling between the tubular portion and the said existing downhole tubular, thereby providing a method of hanging a new tubular portion from a previously installed, existing downhole tubular, such that a liner hanger is provided.

16. The method of claim 12, further providing at least two axially spaced annular seals on an outer surface of the tubular portion and expanding part of the tubular portion between the seals and subsequently expanding the tubular portion in the region of the seals.

* * * * *